US005485988A

United States Patent [19]

Nobilec

[11] Patent Number: 5,485,988

[45] Date of Patent: Jan. 23, 1996

[54] CLAMPING MEANS FOR SKI, OR THE LIKE

[76] Inventor: Leslaw Nobilec, 544 Tennyson Ave., Syracuse, N.Y. 13204

[21] Appl. No.: 251,085

[22] Filed: May 31, 1994

[51] Int. Cl.[6] ..... B25B 11/00

[52] U.S. Cl. ..... 269/21; 269/97; 269/296; 269/906

[58] Field of Search ..... 248/105.5–206.4; 294/64.1, 65; 451/388; 279/3; 269/21, 98, 97, 906, 296

[56] References Cited

U.S. PATENT DOCUMENTS

| | | |
|---|---|---|
| 3,591,118 | 7/1971 | Gentile . |
| 3,854,712 | 12/1974 | McGee . |
| 3,861,664 | 1/1975 | Durkee . |
| 3,912,902 | 10/1975 | Herniter . |
| 4,066,250 | 1/1978 | Campbell . |
| 4,175,736 | 11/1979 | Dietlien . |
| 4,262,890 | 4/1981 | Sisko et al. . |
| 4,708,381 | 11/1987 | Lundback . |

FOREIGN PATENT DOCUMENTS

| | | |
|---|---|---|
| 3432686 | 3/1986 | Germany . |
| 3838913 | 5/1990 | Germany . |

*Primary Examiner*—Robert C. Watson
*Attorney, Agent, or Firm*—Charles S. McGuire

[57] ABSTRACT

A vacuum-type clamping device for releasably holding a ski or other workpiece in a stationary position. The device is attached to a table by a C-clamp having the usual threaded rod. A suction cup is fixedly mounted on the non-clamping end of the rod and a nut carrying a rigid support ring having a pair of diametrically opposed contact portions is threadedly engaged with the rod. A surface of the workpiece is pressed into engagement with the upwardly facing, concave surface of the suction cup. The nut is then advanced on the threaded rod to bring the contact portions of the ring into engagement with the workpiece surface at positions on opposite sides of and spaced outwardly from the peripheral lip of the suction cup. Continued advance of the nut urges the workpiece away from the cup, thereby increasing the clamping force to the desired degree. The nut is rotated in the opposite direction to permit removal of the workpiece.

11 Claims, 2 Drawing Sheets

CLAMPING MEANS FOR SKI, OR THE LIKE

BACKGROUND OF THE INVENTION

1. Field of the Invention

The present invention relates to workpiece clamping means, and is disclosed in one of its principal contemplated applications, as a means of temporarily supporting a ski in a fixed position while waxing or other operations are performed thereon. More specifically, the invention relates to an improved form of vacuum clamping means utilizing a resilient suction cup.

2. The Prior Art

Traditionally, skis have been supported for waxing, repair, and other operations by vises which are typically heavy, cumbersome and costly. Alternative apparatus for temporary support of skis, or other workpieces, has included vacuum clamping means employing resiliently deformable members such as so-called suction cups. However, each such prior art device is deficient in at least one respect, such as complexity of manufacture and/or operation, degree of holding power, cost of fabrication, etc.

OBJECTS OF THE INVENTION

Accordingly, it is an object of the present invention to provide a vacuum type clamping device for temporarily supporting a ski or other workpiece in a fixed position which exhibits superior holding power while remaining relatively simple in construction and operation.

A further object is to provide a clamping device of compact, lightweight and economical design with means for applying a selectively and continuously variable vacuum to effect stabilization of the workpiece.

Another object is to provide a novel and improved method of clamping a ski, or the like, in a stationary position through the agency of a deformable suction cup.

Other objects will in part be obvious and will in part appear hereinafter.

SUMMARY OF THE INVENTION

In accordance with the foregoing objects, the clamping device of the invention comprises, in the disclosed embodiment, a C-clamp including a threaded rod for attachment of the device to an edge of a work table or other such support. A conventional rubber suction cup is supported upon the end of the threaded rod outwardly of the C-clamp. A nut is threadedly engaged on the rod and a support ring is coupled to the nut for free rotation with respect thereto.

In a typical manner of use, the C-clamp is firmly attached to a work table in the usual manner by rotation of the threaded rod, with the concave surface of the suction cup facing upwardly. When used to support an elongated workpiece such as a ski, two such clamping devices will normally be attached in spaced relation to the work table. The downwardly facing surface of the workpiece is then pressed firmly into engagement with the concave surface of the suction cup, preferably after moistening one or both surfaces to improve bonding, tending to flatten the cup.

The nut is then advanced on the threads of the rod, moving the support ring toward the lower surface of the workpiece. The support ring includes a pair of contact portions on diametrically opposite sides which are spaced outwardly of the periphery of the suction cup. As these contact portions are moved to engage the workpiece, and the nut is further advanced, the workpiece is urged away from the suction cup, thereby increasing the volume defined by the concave surface thereof without admitting additional air into the cup. This, of course, has the effect of increasing the vacuum, i.e., the sub-atmospheric pressure applied to the lower surface of the workpiece.

In order to remove the workpiece, the nut is retracted on the threaded rod to move the support ring and its contact portion out of engagement with the lower surface of the workpiece. This permits the suction cup to return essentially to its original condition, lowering the vacuum and permitting the workpiece to be pulled free of the suction cup relatively easily.

The foregoing and other features of the clamping device and method of clamping a workpiece will be more readily understood and fully appreciated from the following detailed description, taken in conjunction with the accompanying drawings.

DETAILED DESCRIPTION

Figure 1:
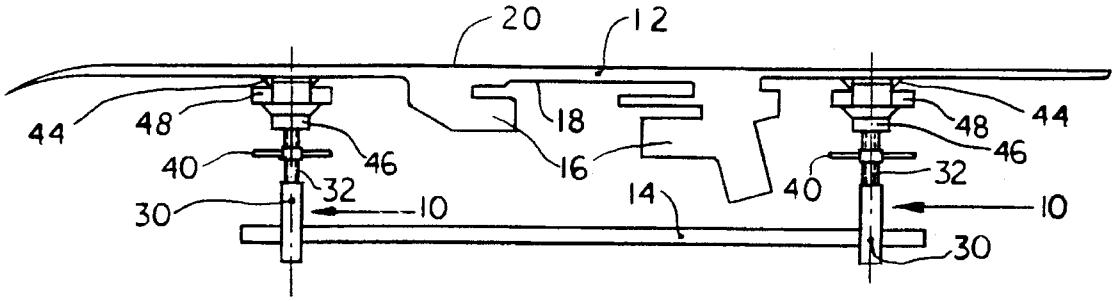
FIG. 1 is a side elevational view of a ski positioned upon a pair of the clamping devices of the present invention, the devices being removably attached in spaced relation to a work table.

Referring now to the drawings, in FIG. 1 a pair of clamping devices 10, representing the currently preferred embodiment of the invention, are shown with an elongated workpiece 12 positioned thereon. Clamping devices 10 are removably attached, in appropriately spaced relation, to an edge of a work table, a portion of which is denoted by reference numeral 14. In the illustrated application, workpiece 12 is a ski, having bindings 16 mounted upon what is normally the upper surface 18, the ski being inverted to place the normally lower surface 20 in an upwardly facing direction, e.g., for application of wax while the ski is held firmly stationary by clamping devices 10. The ski has side edges 22 and 24, parallel to a central, longitudinal axis and joined by radiused portions 26 and 28, respectively, to surface 18.

Figure 4:
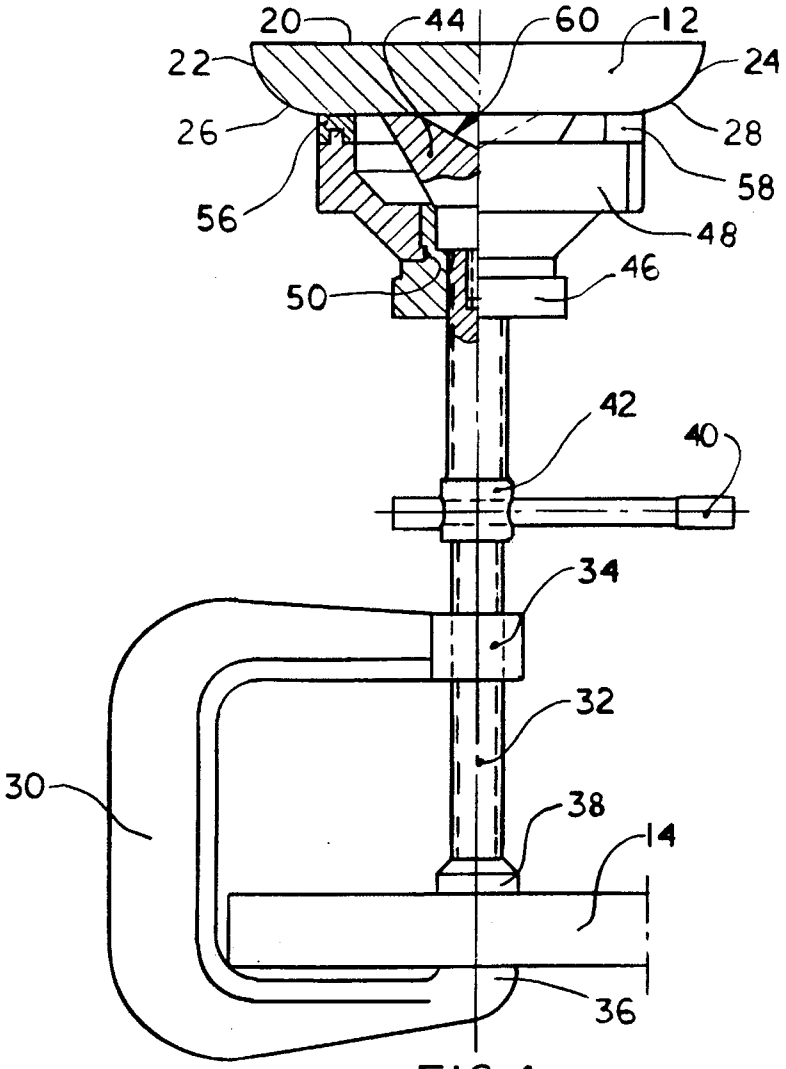
FIG. 4 is a front elevational view with portions in half-section and moveable elements in a second operative position.

As best seen in FIG. 4, device 10 is attached to table 14 by a conventional C-clamp including body 30 and threaded rod 32 extending through an internally threaded opening in body portion 34. An edge of table 14 is engaged between clamp body portion 36 and end portion 38 of rod 32 by advancing rod 32 in a downward direction through the opening in body portion 34 as the rod is rotated by manually turning handle 40 which extends through an opening in collar portion 42 of rod 32.

Conventional rubber suction cup 44 is fixedly attached to the end of threaded rod 32 opposite clamping end portion 38. Cup 44 has the usual circular, peripheral lip surrounding a concave surface having a central axis indicated at A—A in FIG. 2. Nut 46 is threadedly engaged on rod 32 for reciprocal, axial movement with respect to the rod by manual rotation of nut 46. Rigid ring 48 is affixed to nut 46 by means of annular portion 50 extending into a groove in the nut, whereby ring 48 is moved axially of rod 32 together with nut 46 while the ring and nut may be rotated relative to one another. A pair of contact members 52 and 54 are affixed to opposite sides of ring 48, although the contact members may be formed integrally with the ring, if desired. Preferably, at least the portions of members 52 and 54 which contact the workpiece surface, in a manner described hereinafter, are of rubber or other somewhat resilient material, such portions being denoted by reference numerals 56 and 58.

Figure 2:
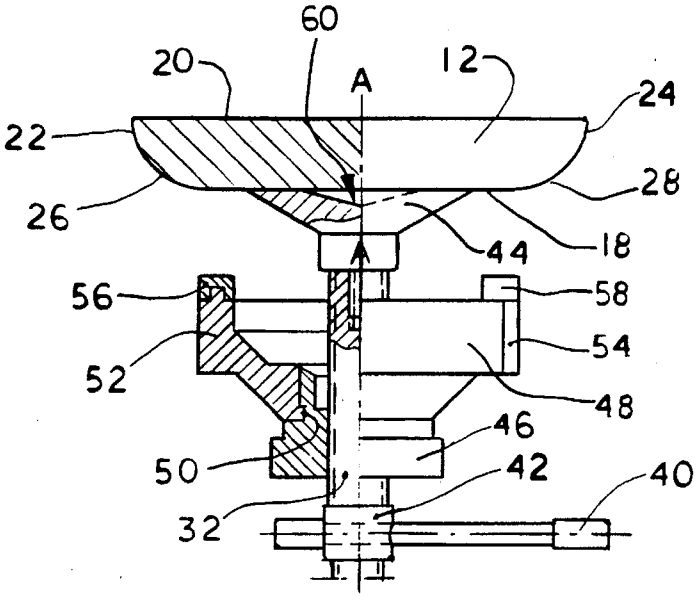
FIG. 2 is a fragmentary, front elevational view, in half-section of the clamping device with certain elements shown in a first position with respect to a ski positioned thereon.

In order to mount a ski or other workpiece 12 upon device 10, or a spaced plurality of devices 10, the surface to be clamped, e.g., surface 18, is placed in contact with the circular, peripheral lip of suction cup 44, preferably after moistening one or both of the lip and opposing surface to provide a liquid bond between the two. Cup 44 is substantially centered between edges 22 and 24 of the workpiece. Workpiece 12 is then pressed downwardly, toward the concave surface of suction cup 44, thereby deforming the peripheral lip of the cup outwardly, in sliding contact with surface 18 and reducing the volume defined by the concave cup surface and the portion of surface 18 surrounded by the cup lip. This step is performed with nut 46 and ring 48 at a position on rod 32 such that contact portions 56 and 58 are spaced from surface 18, as shown in FIG. 2.

Figure 3:
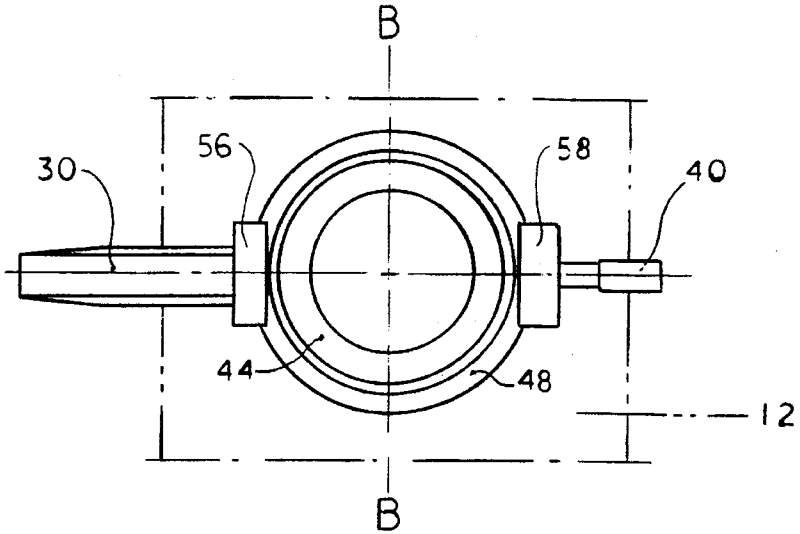
FIG. 3 is a top plan view of the clamping device.

Nut 46 is then rotated to move contact portions 56 and 58 into contact with surface 18, preferably on opposite sides of the longitudinal axis B—B of workpiece 12, indicated in phantom lines in FIG. 3. Further advance of nut 46 in this direction, while ring 48 remains rotationally stationary, urges surface 18 away from suction cup 44, thereby increasing the volume, indicated in FIGS. 2 and 4 by reference numeral 60, defined by the concave surface of the cup and the opposing portion of surface 18. The peripheral lip of cup 44, of course, remains in sealed engagement with surface 18, whereby the increase in volume 60 without entry of additional air increases the differential between atmospheric pressure and the sub-atmospheric pressure within volume 60. Nut 46 is advanced in this manner to produce a steady increase in the clamping force until it reaches the desired level.

In order to remove workpiece 12, nut 46 is rotated in the opposite direction to move, together with ring 48, axially down rod 32. When contact portions 56 and 58 are moved away from surface 18, suction cup 44 may return to its condition of FIG. 2 and workpiece 12 may be relatively easily be pulled free of suction cup(s) 44.

What is claimed is:

1. A device for releasably engaging a workpiece surface to hold the workpiece in a temporarily fixed position in spaced relation to rigid support means, said apparatus comprising:

a) clamp means for releasable attachment to said support means;

b) a resilient suction cup fixed with respect to said clamp means, said suction cup having a peripheral lip engageable with said workpiece surface and surrounding a concave surface having a central axis, said concave surface defining a volume variable in accordance with the degree of concavity of said concave surface;

c) a member having a contact portion movable with respect to said suction cup in outwardly spaced relation to said peripheral lip in a direction substantially parallel to said central axis, whereby movement of said contact portion to urge said workpiece surface in a direction away from said suction cup increases said volume and the clamping force applied to said surface; and d) means for selectively moving said member and contact portion into and out of engagement with said workpiece surface.

2. The device of claim 1 wherein said suction cup is fixedly supported on one end of a threaded rod.

3. The device of claim 2 wherein said means for moving comprises a nut threadedly engaged with said rod for reciprocal, axial movement thereon.

4. The device of claim 3 wherein said member comprises a rigid ring rotatably coupled to said nut.

5. The device of claim 4 wherein said clamp means comprises a C-clamp which includes said threaded rod.

6. The device of claim 1 wherein said clamp means comprises a body portion and a threaded rod moveable axially through a threaded opening in a first part of said body portion for movement of one end of said rod into and out of engagement with said support means, and wherein said suction cup is mounted upon the other end of said rod with said central axis substantially coaxial with the longitudinal axis of said rod and said concave surface facing away from said other end.

7. The device of claim 6 wherein said means for moving comprises a nut threaded on said rod for axial movement with respect thereto.

8. The device of claim 7 wherein said member is coupled to said nut for axial movement therewith.

9. The device of claim 8 wherein said member is freely rotatable with respect to said nut.

10. The device of claim 9 wherein said contact portion comprises a pair of surfaces into and away from the plane of said lip, said surfaces being spaced outwardly of said lip on opposite sides thereof when in said plane.

11. The device of claim 10 wherein said surfaces are formed of resilient material.

* * * * *